US010561908B2

(12) United States Patent
Mizutani

(10) Patent No.: US 10,561,908 B2
(45) Date of Patent: Feb. 18, 2020

(54) GOLF CLUB HEAD

(71) Applicant: DUNLOP SPORTS CO. LTD., Kobe-shi, Hyogo (JP)

(72) Inventor: Naruhiro Mizutani, Kobe (JP)

(73) Assignee: SUMITOMO RUBBER INDUSTRIES, LTD., Kobe-shi, Hyogo (JP)

( * ) Notice: Subject to any disclaimer, the term of this patent is extended or adjusted under 35 U.S.C. 154(b) by 345 days.

(21) Appl. No.: 14/980,767

(22) Filed: Dec. 28, 2015

(65) Prior Publication Data

US 2016/0184664 A1 Jun. 30, 2016

(30) Foreign Application Priority Data

Dec. 25, 2014 (JP) ..... 2014-262579

(51) Int. Cl.
*A63B 53/04* (2015.01)
*A63B 60/52* (2015.01)

(52) U.S. Cl.
CPC ..... *A63B 53/0466* (2013.01); *A63B 60/52* (2015.10); *A63B 2053/045* (2013.01); *A63B 2053/0408* (2013.01); *A63B 2053/0437* (2013.01); *A63B 2053/0462* (2013.01)

(58) Field of Classification Search
CPC ..... A63B 2053/0437; A63B 2053/045; A63B 2053/0458; A63B 2053/0462; A63B 53/047
See application file for complete search history.

(56) References Cited

U.S. PATENT DOCUMENTS 6,354,962 B1 * 3/2002 Galloway ..... A63B 53/02 473/342
7,241,230 B2 * 7/2007 Tsunoda ..... A63B 53/04 473/324
7,442,132 B2 * 10/2008 Nishio ..... A63B 53/0466 473/342
7,445,564 B2 * 11/2008 Kusumoto ..... A63B 53/0466 473/346
7,455,597 B2 * 11/2008 Matsunaga ..... A63B 53/0466 473/329

(Continued)

FOREIGN PATENT DOCUMENTS

JP 2005-6698 A 1/2005
JP 2008-35963 A 2/2008

OTHER PUBLICATIONS

Japanese Office Action, dated Jul. 24, 2018, for Japanaes Application No. 2014-262579, along with an English translation.

*Primary Examiner* — William M Pierce
(74) *Attorney, Agent, or Firm* — Birch, Stewart, Kolasch & Birch, LLP

(57) ABSTRACT

A golf club head including a face portion having an improved restitution factor is provided. The golf club head has a hollow structure and includes a face portion, a crown portion, a sole portion, and a side portion. The crown portion includes a first region that spreads out forward of a boundary line that extends from a heel side to a toe side, and a second region that spreads out rearward of the boundary line and is thinner than the first region. The crown portion further includes a protruding portion formed at position that is in a vicinity of the boundary line, is on the second region, and is rearward of the boundary line via a gap.

16 Claims, 5 Drawing Sheets

(56) References Cited

U.S. PATENT DOCUMENTS 7,704,162 B2 * 4/2010 Rice ..... A63B 60/00 473/329
8,047,931 B2 * 11/2011 Yokota ..... A63B 53/0466 473/342
8,647,217 B2 * 2/2014 Nishio ..... A63B 53/04 473/342
8,986,133 B2 * 3/2015 Bennett ..... A63B 53/06 473/329
9,033,822 B1 * 5/2015 DeMille ..... A63B 53/0466 473/345
9,498,688 B2 * 11/2016 Galvan ..... A63B 60/00
9,636,552 B2 * 5/2017 Cleghorn ..... A63B 60/54
9,839,820 B2 * 12/2017 Bennett ..... A63B 53/0466
9,901,789 B2 * 2/2018 Kitagawa ..... A63B 53/0466
9,901,791 B2 * 2/2018 Mizutani ..... A63B 53/0466
9,914,030 B2 * 3/2018 Cleghorn ..... A63B 53/0466
9,937,389 B2 * 4/2018 Kitagawa ..... A63B 53/0466
9,937,390 B2 * 4/2018 Luttrell ..... A63B 53/06
10,150,016 B2 * 12/2018 Willett ..... A63B 53/0466
10,238,925 B2 * 3/2019 Boggs ..... A63B 53/04
2004/0053705 A1 * 3/2004 Kumamoto ..... A63B 53/0466 473/345
2005/0124436 A1 * 6/2005 Kakiuchi ..... A63B 53/0466 473/345
2005/0221913 A1 * 10/2005 Kusumoto ..... A63B 53/0466 473/345
2007/0049405 A1 * 3/2007 Tateno ..... A63B 53/0466 473/345
2007/0049406 A1 * 3/2007 Tateno ..... A63B 53/0466 473/345
2007/0049407 A1 * 3/2007 Tateno ..... A63B 53/0466 473/345
2011/0039636 A1 * 2/2011 Cackett ..... A63B 53/0466 473/342
2013/0109500 A1 * 5/2013 Boyd ..... A63B 53/047 473/332
2013/0331201 A1 * 12/2013 Wahl ..... A63B 53/0475 473/329
2015/0045147 A1 * 2/2015 Abe ..... A63B 60/00 473/345
2015/0072803 A1 * 3/2015 Golden ..... A63B 53/0466 473/345

* cited by examiner

GOLF CLUB HEAD

CROSS REFERENCE TO RELATED APPLICATIONS

This application claims a priority to Japanese Patent Application No. 2014-262579 filed on Dec. 25, 2014, which is hereby incorporated by reference in its entirety.

FIELD OF INVENTION

The present invention relates to a golf club head.

BACKGROUND

Conventionally, various attempts have been made to increase the restitution factor of the face portion of a golf club head in order to extend the flight-distance of a hit ball. For example, in JP 2005-6698A, a cup face construction is employed in order to increase the restitution factor of the face portion. In the case where a cup face construction is employed, the connection portion (welding portion) of the face member and the head body, where rigidity tends to increase, moves rearward of the face portion (face surface), and therefore the overall face portion flexes easily, and the restitution factor of the face portion improves.

SUMMARY of INVENTION

Incidentally, in many cases, the golf club head is formed by connecting a head member, which is constituted by a crown portion, a sole portion, a side portion, and the like, to the face member that includes the face portion. Accordingly, the ease of flexure of the face portion is influenced by not only the configuration of the face member, but also the configuration of the head member. In view of this, the inventors of the present invention sought a method for effectively improving the restitution factor of the face portion by making the head member flex more easily.

An object of the present invention is to provide a golf club head that includes a face portion having an improved restitution factor.

A golf club head according to a first aspect of the present invention is a golf club head with a hollow structure including a face portion, a crown portion, a sole portion, and a side portion. The crown portion includes a first region that spreads out forward of a boundary line that extends from a heel side to a toe side, and a second region that spreads out rearward of the boundary line and is thinner than the first region. The crown portion further includes a protruding portion formed at position that is in a vicinity of the boundary line, is on the second region, and is rearward of the boundary line via a gap.

A golf club head according to a second aspect of the present invention is the golf club head according to the first aspect, wherein the boundary line extends from the heel side to the toe side along a line that constitutes a ridge line of an apex portion when the golf club head in a reference state is viewed from the face portion side, or along a line adjacent to the line.

A golf club head according to a third aspect of the present invention is the golf club head according to the first aspect or the second aspect, wherein the boundary line extends from a front side to a rear side as it extends from the heel side to the toe side.

A golf club head according to a fourth aspect of the present invention is the golf club head according to any of the first to third aspects, wherein the protruding portion is constituted by a plurality of ribs aligned along the boundary line.

A golf club head according to a fifth aspect of the present invention is the golf club head according to the fourth aspect, wherein the ribs extend in the face-back direction.

A golf club head according to a sixth aspect of the present invention is the golf club head according to any of the first to fifth aspects, wherein the second region includes a thickness transition portion that is thinner than the first region, and a thin portion that is thinner than the thickness transition portion and spreads out rearward of the thickness transition portion. The thickness transition portion extends from the heel side to the toe side with it being in contact with the boundary line.

A golf club head according to a seventh aspect of the present invention is the golf club head according to any of the first to sixth aspects, further including a rising portion that extends rearward from a peripheral edge of the face portion. The crown portion, the sole portion, and the side portion constitute a head body with a hollow structure that has an opening on a front side. The rising portion, together with the face portion, constitutes a cup face member that is connected to the head body so as to block the opening on the front side of the head body.

A golf club head according to an eighth aspect of the present invention is the golf club head according to the seventh aspect, wherein the rising portion includes an upper rising portion that is connected to a front edge of the first region. Letting w1 be the thickness of the upper rising portion, and w2 be the thickness of a front edge portion of the crown portion, a relationship $w2+1\text{ mm}>w1>w2-1\text{ mm}$ is satisfied.

A golf club head according to a ninth aspect of the present invention is the golf club head according to any of the first to eighth aspects, wherein a sweet spot is located on a heel side relative to a face center on the face portion.

A golf club head according to a tenth aspect of the present invention is the golf club head according to any of the first to ninth aspects, wherein the face portion includes a central portion that extends so as to be inclined from a top side to a sole side along a direction from the heel side to the toe side, and a peripheral region that is thinner than the central portion and surrounds the central portion.

A golf club head according to an eleventh aspect of the present invention is the golf club head according to the tenth aspect, wherein the peripheral region has a transition portion that surrounds the central portion, and a thin portion that surrounds the transition portion and is thinner than the transition portion. The central portion is arranged so as to be closer to the heel side than to the toe side in a region made up of the central portion and the transition portion.

A golf club head according to a twelfth aspect of the present invention is the golf club head according to the tenth aspect or the eleventh aspect, wherein the face portion has a toe-side end point that is a point farthest on the toe side and a heel-side end point that is a point farthest on the heel side. The face portion further includes a region that is thinner than the peripheral region and extends along a peripheral edge of the face portion at least one of in a vicinity of the toe-side end point and in a vicinity of the heel-side end point.

According to the first aspect, in the crown portion, a thick region (the first region) spreads out in front of the boundary line that extends in the toe-heel direction, and a thin region (the second region) spreads out rearward of the boundary line. The boundary line that is between these two regions and extends in the toe-heel direction is an origin of flexure of the golf club head due to the difference in thickness in front of it and behind it. In other words, bending points that extend in the toe-heel direction are formed approximately along the boundary line, thus making it possible to allow the golf club head to undergo a large amount of flexure. Accordingly, flexure of the rearward thin region easily propagates to the face portion, and it is possible to improve the restitution factor of the face portion. Also, according to the first aspect, a protruding portion is formed on the thin region in the vicinity of the boundary line, thus increasing the rigidity at the location of the protruding portion. Accordingly, a large amount of flexure is expected due to causing bending to originate in the vicinity of the boundary line, thus making it possible to improve the restitution factor of the face portion.

DETAILED DESCRIPTION OF THE PREFERRED EMBODIMENTS

A golf club head according to an embodiment of the present invention will be described below with reference to the drawings.

1. Overview of Golf Club Head

Figure 1:
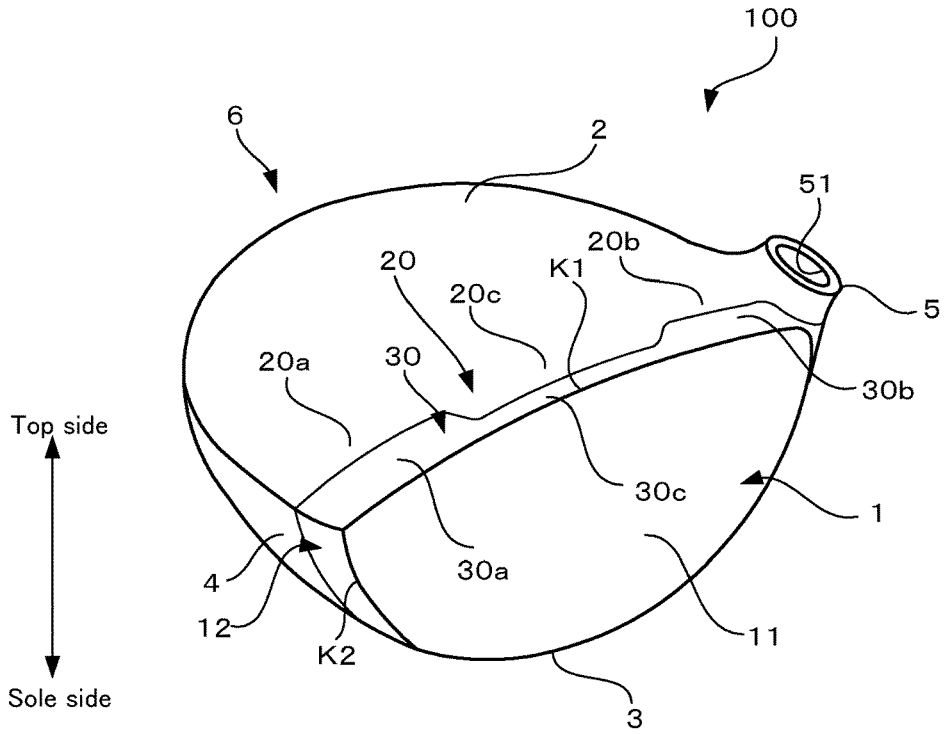
FIG. 1 is a perspective view of a golf club head according to an embodiment in a reference state.
Figure 2:
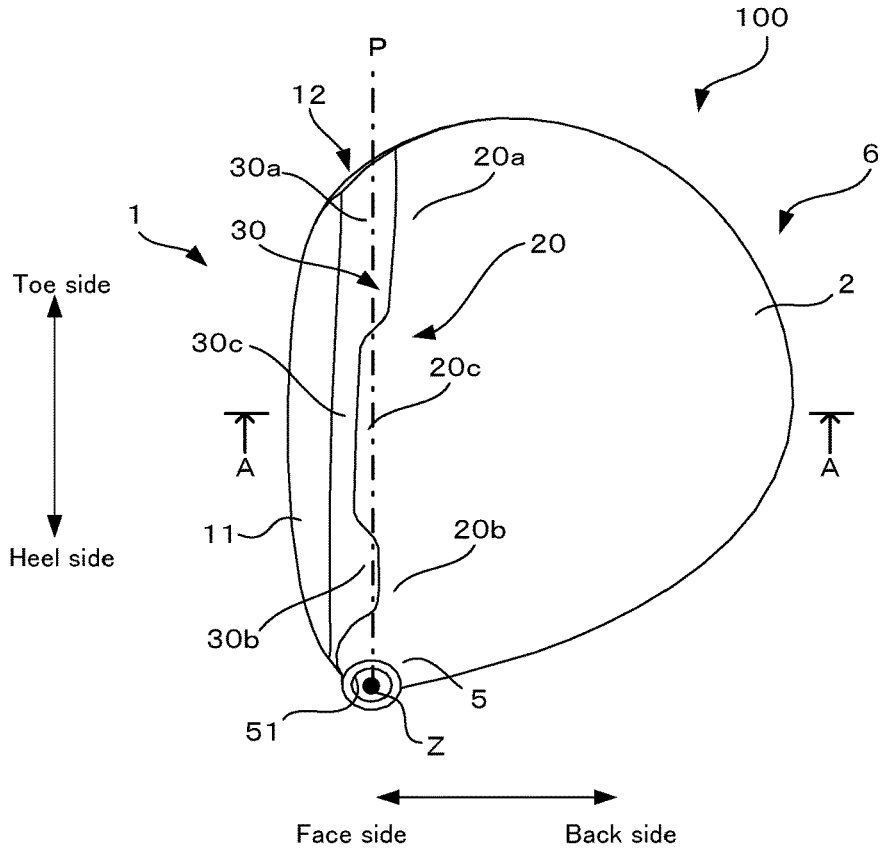
FIG. 2 is a plan view of the golf club head in the reference state.

FIG. 1 is a perspective view of a golf club head (hereinafter sometimes simply referred to as the "head") 100 of the present embodiment in a reference state, and FIG. 2 is a plan view of the head 100 in the reference state. Note that the reference state of the golf club head will be described later. The head 100 is a hollow structure and has wall surfaces formed by a face member 1, a crown portion 2, a sole portion 3, a side portion 4, and a hosel portion 5.

The face member 1 constitutes a front portion of the head 100 that serves as the surface for hitting a ball. The crown portion 2 is adjacent to the face member 1 and constitutes the upper surface of the head 100. The sole portion 3 constitutes the bottom surface of the head 100, and is adjacent to the face member 1 and the side portion 4. Also, the side portion 4 is the portion between the crown portion 2 and the sole portion 3, and extends from the toe side of the face member 1, across the back side of the head 100, to the heel side of the face member 1. Furthermore, the hosel portion 5 is the portion provided adjacent to the heel side of the crown portion 2, and has an insertion hole 51 for the insertion of the shaft (not shown) of the golf club. A central axis Z of the insertion hole 51 conforms to the axis of the shaft. The head 100 described here is a wood-type head such as a driver (#1) and a fairway wood, but there is no limitation on the type, and it may be of the so-called utility-type, hybrid-type, or the like.

The following describes the aforementioned reference state. As shown in FIGS. 1 and 2, the reference state is defined as a state in which the central axis Z is in a plane P (hereinafter, the reference vertical plane P) that is perpendicular to a horizontal plane H (see FIG. 3), and furthermore the head is placed on the horizontal plane H at a predetermined lie angle and real loft angle. Also, as shown in FIG. 2, the direction of the line of intersection of the reference vertical plane P and the horizontal plane H will be referred to as the toe-heel direction, and the direction that is perpendicular to the toe-heel direction and parallel to the horizontal plane H will be referred to as the face-back direction. Also, the direction perpendicular to the horizontal plane H will be referred to as the top-sole direction. Note that in the description of the present embodiment, unless otherwise stated, "forward-rear" means the face-back direction, the "face side" is forward, and the "back side" is rearward. Also, unless otherwise stated, "up-down" refers to the top-sole direction, the "top side" is upward, and the "sole side" is downward.

The head 100 can be formed from a titanium alloy having a specific gravity of approximately 4.4 to 5.0 (e.g., Ti-6Al-4V), for example. Besides a titanium alloy, the head can be formed from one or two or more materials selected from among stainless steel, maraging steel, an aluminum alloy, a magnesium alloy, an amorphous alloy, and the like. Also, there is no limitation to a metal material, and the head can also be formed using a fiber-reinforced plastic or the like.

The head 100 of the present embodiment is constituted by assembling the face member 1 with a head body 6 that is a hollow structure having the crown portion 2, the sole portion 3, the side portion 4, and the hosel portion 5. The head body 6 and the face member 1 are joined by welding (TIG (Tungsten-Inactive Gas) welding, plasma welding, laser welding, brazing, etc.), for example. The head body 6 has an opening on the front side surrounded by the crown portion 2, the sole portion 3, and the side portion 4, and the face member 1 is attached so as to block this opening. The head body 6 can also be an assembly of multiple parts, or can also be formed as a single body. The head body 6 and the face member 1 can be produced using various methods. For example, the head body 6 can be manufactured by casting using a known lost-wax precision casting method or the like. Also, the face member 1 can be manufactured using a forging method, flat plate press machining, casting, or the like.

Figure 3:
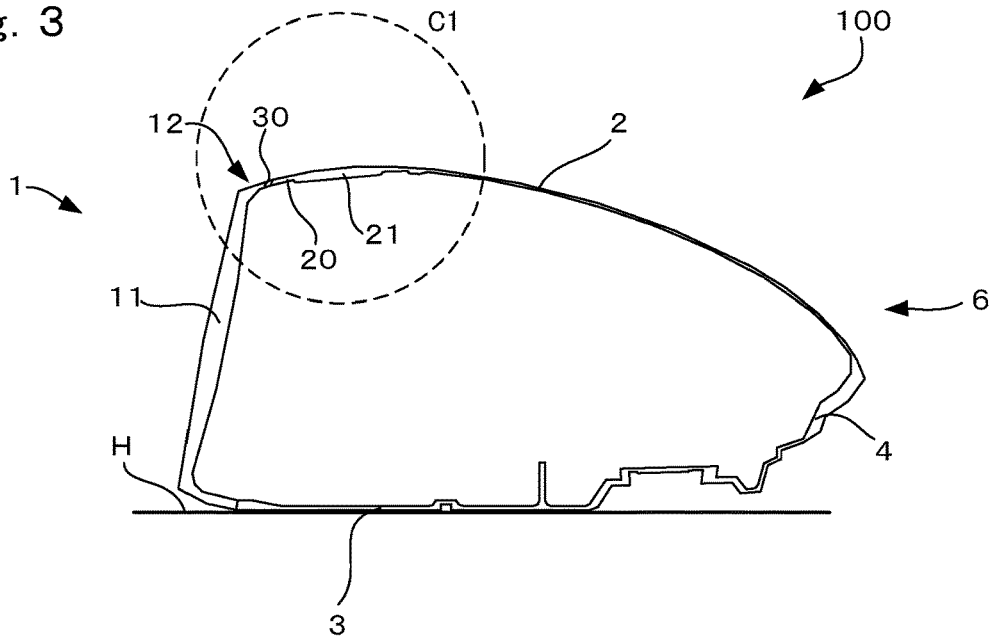
FIG. 3 is a cross-sectional view taken along line A-A in FIG. 2.

Hereinafter, the face member 1 will be described with reference to FIG. 3 as well. FIG. 3 is a cross-sectional view taken along line A-A in FIG. 2. As shown in FIGS. 1 to 3, the face member 1 of the present embodiment is of the so-called "cup face" type. In other words, the face member 1 is shaped as a cup that has a flat plate-shaped face portion 11 for hitting a ball and a rising portion (extending portion) 12 that extends rearward from the peripheral edge of the face portion 11.

This cup face-type face member 1 has a higher restitution factor in the face portion 11 than a face member not having a rising portion, because the area of flexure is larger by an amount corresponding to the rising portion 12. Also, in the case where the cup face construction is employed, the connection portion of the face member 1 and the head body 6, where rigidity tends to increase, moves rearward of the face portion 11, and therefore the overall face portion 11 flexes easily. Accordingly, the cup face construction contributes to an increase in flight-distance.

Additionally, various innovations have been made to the golf club head 100 in order to improve the restitution factor of the face portion 11 for the purpose of increasing the flight-distance. Specifically, a characteristic structure has been formed in the vicinity of the connection portion of the face member 1 and the head body 6, and an innovation has also been made to the thickness structure of the crown portion 2 and the face portion 11. These features will be described below in order.

2. Structure in Vicinity of Connection Portion of Face Member and Head Body

As shown in FIGS. 1 and 2, a front edge portion 20 of the crown portion 2 has a protruding shape in which a central region thereof projects forward. Specifically, the front edge portion 20 of the crown portion 2 has a first toe-side portion 20*a* that is on the toe side, a first heel-side portion 20*b* that is on the heel side, and a first central portion 20*c* located between the portions 20*a* and 20*b*, and the first central portion 20*c* projects forward more than the first toe-side portion 20*a* and the first heel-side portion 20*b*. On the other hand, in the rising portion 12 of the face member 1, the portion fixed to the front edge portion 20 of the crown portion 2 (hereinafter, the fixed portion being referred to as the "upper rising portion 30) has a structure that corresponds to the above-described structure of the crown portion 2. Specifically, the upper rising portion 30 has a protruding shape in which the two side regions project rearward. Specifically, the upper rising portion 30 has a second toe-side portion 30*a* that is joined to the first toe-side portion 20*a*, a second heel-side portion 30*b* that is joined to the first heel-side portion 20*b*, and a second central portion 30*c* that is joined to the first central portion 20*c*. Also, the second toe-side portion 30*a* and the second heel-side portion 30*b* project rearward more than the second central portion 30*c*. Note that the second central portion 30*c* is the portion located between the second toe-side portion 30*a* and the second heel-side portion 30*b*.

The protruding shape of the front edge portion 20 of the crown portion 2 and the protruding shape of the upper rising portion 30 of the face member 1 contribute to an enlargement of the high restitution area on the face portion 11. Specifically, the connection portion of the face member 1 and the head body 6 moves closer to a position toward the face portion 11 in the vicinity of the center in the toe-heel direction, and therefore the restitution factor in the central region of the face portion 11 decreases. As a result, the amount of flexure during ball-hitting relatively increases in the toe-side and heel-side portions of the face portion 11, and thus the restitution factor improves in the face portion 11 overall.

Figure 4:
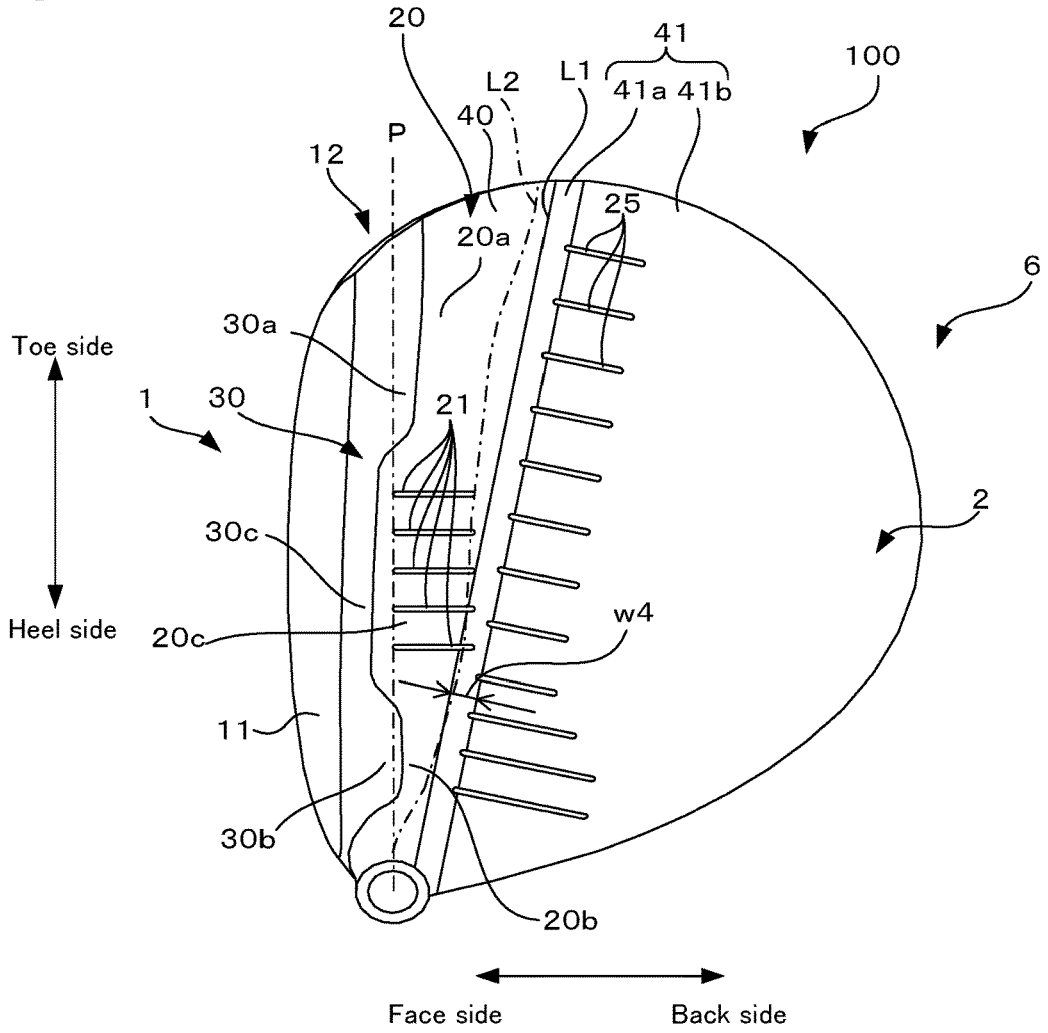
FIG. 4 is a plan view of the golf club head in the reference state, showing a structure of an inner surface of a crown portion.

In order to enhance the above effect of enlarging the high restitution area, the first central portion 20*c* is constituted so as to have a higher rigidity than the first toe-side portion 20*a* and the first heel-side portion 20*b*. Specifically, as shown in FIGS. 3 and 4, multiple ribs 21 are formed on the inner surface of the first central portion 20*c*. Note that FIG. 4 is a plan view of the head 100 in the reference state. Accordingly, it would not be possible to see the ribs 21 formed on the inner surface of the crown portion 2 in this figure. However, in consideration of facilitating understanding, the positions of the ribs 21 are shown in the figure. The same also follows for ribs 25, a thickness transition portion 41*a*, raised portions 28, and the like that will be described later. Note that in the present embodiment, protrusions and recessions caused by these portions 21, 25, 41*a*, and 28 do not appear on the outer surface of the crown portion 2. In other words, the outer surface of the crown portion 2 has a smooth configuration.

In the present embodiment, the ribs 21 extend as elongated straight lines in the face-back direction. Accordingly, it is possible to effectively increase the rigidity of the first central portion 20*c* and suppress the restitution factor in the central region of the face portion 11. Note that in the description of the present embodiment, the phrase "extend in the face-back direction" includes not only the case of extending parallel with the face-back direction defined above, but also the case of extending in a direction that intersects the face-back direction. An angle θ1 formed by the face-back direction and the extending direction of the ribs 21 satisfies the relationship $0° \leq \theta 1 < 180°$, more preferably satisfies the relationship $\theta 1 \leq 70°$ or $\theta 1 \geq 110°$, and even more preferably satisfies the relationship $\theta 1 \leq 45°$ or $\theta 1 \geq 135°$.

Figure 5:
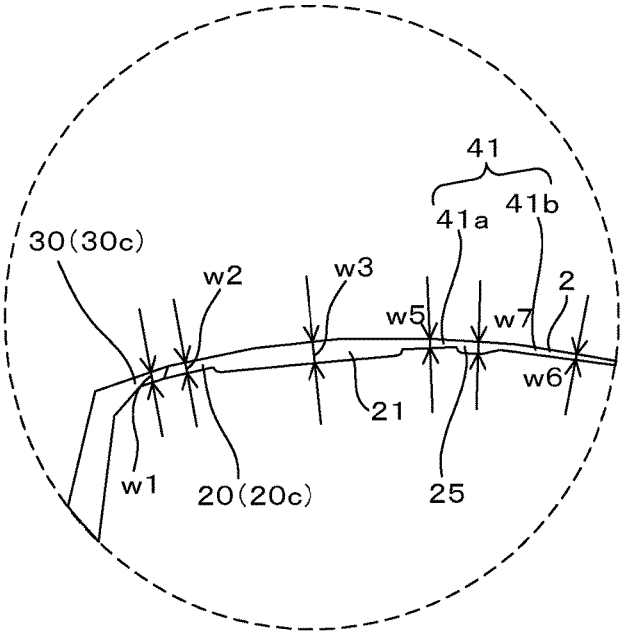
FIG. 5 is an enlarged view of a region in a circle Cl indicated by a dashed line in FIG. 3.

FIG. 5 is an enlarged view of a region in a circle C1 indicated by a dashed line in FIG. 3. In the present embodiment, the upper rising portion 30 overall has a substantially uniform thickness w1. Accordingly, the thicknesses of the second toe-side portion 30*a*, the second heel-side portion 30*b*, and the second central portion 30*c* are approximately the same. Similarly, the front edge portion 20 of the crown portion 2 overall also has a substantially uniform thickness w2. Accordingly, the thicknesses of the first toe-side portion 20*a*, the first heel-side portion 20*b*, and the first central portion 20*c* are approximately the same. The thicknesses w1 and w2 can be set as required, but w1 preferably satisfies the relationship $0.4\ \text{mm} \leq w1 \leq 3.5\ \text{mm}$, more preferably satisfies the relationship $0.6\ \text{mm} \leq w1 \leq 2.0\ \text{mm}$, and even more preferably satisfies the relationship $0.8\ \text{mm} < w1 < 1.5\ \text{mm}$. Also, w2 preferably satisfies the relationship $0.4\ \text{mm} \leq w2 \leq 3.5\ \text{mm}$, more preferably satisfies the relationship $0.6\ \text{mm} \leq w2 \leq 2.0\ \text{mm}$, and even more preferably satisfies the relationship $0.8\ \text{mm} \leq w2 \leq 1.5\ \text{mm}$.

The relationship between the thickness w1 of the upper rising portion 30 and the thickness w2 of the front edge portion 20 of the crown portion 2 is preferably $w1 > w2 - 1$ mm, and is more preferably $w1 > w2 - 0.5$ mm. In this way, if w1 is greater than w2, or there is almost no difference between the two thicknesses w1 and w2, the region of the connection portion of the rising portion 12 and the crown portion 2 becomes the origin of bending during ball-hitting, and can flex a large amount. As a result, it is possible to improve the restitution factor of the face portion 11 overall during ball-hitting. Also, with the above configuration, the upper rising portion 30 region in particular flexes easily along the rear end of the rising portion 12, thus making it possible to raise the ball hitting angle.

Also, although the height of the ribs 21 can be set as required, a thickness w3 ($w3 > w2$) of the portion where the ribs 21 are formed preferably satisfies the relationship $0.6\ \text{mm} \leq w3 \leq 5.0\ \text{mm}$, more preferably satisfies the relationship $0.8\ \text{mm} \leq w3 \leq 3.0\ \text{mm}$, and even more preferably satisfies the relationship $1.0\ \text{mm} \leq w3 \leq 2.0\ \text{mm}$.

According to the structure described above, in the present embodiment, it is possible to suppress the restitution factor in the central region, where the restitution factor tends to increase, in the face portion 11. As a result, it is possible to increase the restitution factor in the heel-side and toe-side portions of the face portion 11, while also adhering to golf competition rules related to the restitution factor. Accordingly, it is possible to enlarge the high restitution area in the face portion 11. As a result, it is possible to increase the flight-distance even if the ball is not grabbed at the central region of the face portion 11 in a mishit or an intentional shot, for example.

3. Thickness Structure of Crown Portion

Next, the thickness structure of the crown portion 2 that contributes to an increase in the flight-distance will be described. Specifically, in the crown portion 2, the rearward region has a lower thickness than the front edge portion 20. In other words, in the crown portion 2, the region forward of a boundary line L1 shown in FIG. 4 is formed as a thick region 40. On the other hand, the region rearward of the boundary line L1 is formed as a thin region 41 that is thinner than the thick region 40. Note that in the present embodiment, the thick region 40 and the front edge portion 20 are equivalent to each other.

The boundary line L1 extends in the toe-heel direction from the vicinity of the heel-side end portion of the crown portion 2 to the vicinity of the toe-side end portion. Note that in the description of the present embodiment, the phrase "extends in the toe-heel direction" is a concept that includes not only the case of extending parallel with the toe-heel direction defined above, but also the case of extending in a direction that intersects the toe-heel direction.

In the present embodiment, the thin region 41 decreases in thickness in a stepwise manner as it extends rearward. Specifically, the thin region 41 includes a thickness transition portion 41*a* that extends from the vicinity of the heel-side end portion of the crown portion 2 to the vicinity of the toe-side end portion, and a thin portion 41*b* that spreads out rearward of the thickness transition portion 41*a*. The front edge of the thickness transition portion 41*a* is defined by the boundary line L1. The thickness transition portion 41*a* is thinner than the thick region 40, and the thin portion 41*b* is thinner than the thickness transition portion 41*a*. The thickness transition portion 41*a* of the present embodiment is an elongated region that extends in the toe-heel direction, and a width w4 (see FIG. 4) thereof is substantially constant along the toe-heel direction. The width w4 preferably satisfies the relationship 0.5 mm≤w4≤10 mm, more preferably satisfies the relationship 1.0 mm≤w4≤8.0 mm, and even more preferably satisfies the relationship 2.0 mm≤w4≤5.0 mm.

The thickness transition portion 41*a* of the present embodiment has a substantially uniform thickness w5 overall, and the thin portion 41*b* also has a substantially uniform thickness w6 overall (see FIG. 5). In other words, the thickness of the crown portion 2 changes in a stepwise manner from the thick region 40 toward the thin portion 41*b*. The thicknesses w5 and w6 can be set as required, but w5 preferably satisfies the relationship 0.3 mm≤w5≤3.5 mm, more preferably satisfies the relationship 0.4 mm≤w5≤2.0 mm, and even more preferably satisfies the relationship 0.4 mm≤w5≤1.5 mm. Also, w6 preferably satisfies the relationship 0.3 mm≤w6≤3.5 mm, more preferably satisfies the relationship 0.4 mm≤w6≤2.0 mm, and even more preferably satisfies the relationship 0.4 mm≤w6≤1.5 mm. Note that a configuration is possible in which the thickness w5 of the thickness transition portion 41*a* gradually decreases in a continuous manner from the thick region 40 toward the thin portion 41*b*.

The upper rising portion 30 and the front edge portion 20 of the crown portion 2 are in the vicinity of the face portion 11, and therefore are easily influenced by a hit. For this reason, it is preferable that the thicknesses w1 and w2 are set relatively high in order to ensure strength. However, if these portions in the vicinity of the face portion 11 are thick, the restitution factor of the face portion 11 tends to decrease. On the other hand, the same level of strength as the front edge portion 20 is not required for the rear portion of the crown portion 2. In view of this, in the present embodiment, the thin region 41 is formed in the rear portion of the crown portion 2, and flexure in the same area is caused to propagate to the face portion 11, thus preventing a reduction in the restitution factor of the face portion 11.

As shown in FIGS. 4 and 5, in the thin region 41, multiple ribs 25 (protruding portions) that are aligned along the boundary line L1 are formed on the inner surface of the front edge portion of the thin portion 41*b*. Specifically, the ribs 25 are formed at positions that are in the vicinity of the boundary line L1 and rearward of the boundary line L1 via somewhat of a gap. Note that as shown in FIG. 4, the ribs 25 of the present embodiment are not only formed on the front edge portion of the thin portion 41*b*, but also extend to the thickness transition portion 41*a*.

Although the height of the ribs 25 can be set as required, a thickness w7 (w7>w5,w6) of the portions where the ribs 25 are formed preferably satisfies the relationship 0.4 mm≤w7≤7.0 mm, more preferably satisfies the relationship 0.6 mm≤w7≤4.0 mm, and even more preferably satisfies the relationship 0.8 mm≤w7≤2.0 mm.

When a ball is hit by the face portion 11, the impact of the hit propagates from the face side to the back side. The ribs 25 configured as described above can effectively increase the rigidity somewhat rearward of the boundary line L1 between the thick region 40 and the thin region 41. As a result, the thickness transition portion 41*a* is a region whose thickness changes a large amount in the face-back direction, and the rigidity rearward thereof is increased by the ribs 25, and thus the crown portion 2 bends a large amount in the thickness transition portion 41*a* during ball hitting. Specifically, during ball hitting, flexure occurs in the vicinity of the connection portion of the rising portion 12 and the crown portion 2 connection portion, and a large amount of flexure also occurs in the vicinity of the boundary line L1, that is to say in the vicinity of the thickness transition portion 41*a*. In this way, flexure occurs at two places in the crown portion 2, thus effectively improving the restitution factor of the face portion 11 overall.

The ribs 25 of the present embodiment extend as elongated straight lines in the face-back direction in order to increase the above-described effect of improving the rigidity. An angle θ2 formed by the face-back direction and the extending direction of the ribs 25 satisfies the relationship 0°≤θ2<180°, more preferably satisfies the relationship θ2≤45° or θ2≥135°, and even more preferably satisfies the relationship θ2≤30° or θ2≥150°.

Also, as shown in FIG. 4, among the ribs 25, the ribs 25 on the heel-side have a longer length in the face-back direction than the other ribs 25. Accordingly, an excessive increase in the restitution factor on the heel side is prevented. The ball hitting pitch decreases if the heel-side portion of the face portion 11 flexes too much, and therefore the ribs 25 on the heel-side have a longer length in order to avoid this decrease, and obtain a comfortably high ball hitting sound.

A line L2 shown as a dashed-dotted line in FIG. 4 indicates the position of the apex portion of the crown portion 2. The line L2 is a line that constitutes the ridge line of the apex portion when viewing the head 100 in the reference state in the face-back direction from the face portion 11 side. As can be seen from this figure, in the present embodiment, the boundary line L1 and the thickness transition portion 41*a* rearward thereof extend from the heel side to the toe side in the vicinity of the line L2 that defines the apex portion of the crown portion 2. In general, the apex portion of the crown portion 2 tends to become the origin of bending, and as described above, in the present embodiment, the boundary line L1 between the thick region 40 and the thin region 41 is defined in the vicinity of the line L2. As a result, it is possible to amplify flexure originating at the apex portion of the crown portion 2. As shown in FIG. 4, in the present embodiment, the ridge line of the apex portion extends from the front side to the rear side as it extends from the heel side to the toe side, and the boundary line L that follows the ridge line of the apex portion also extends in a similar manner. However, the extending directions of the ridge line of the apex portion and the boundary line L are not limited to these directions, and they may, for example extend so as to extend from the front side to the rear side as they extend from the toe side to the heel side.

Also, in the case where the thickness w1 of the upper rising portion 30 and the thickness w2 of the thick region 40 satisfy the relationship w2+1 mm>w1>w2−1 mm, more preferably in the case where they satisfy the relationship w2+0.8 mm>w1>w2−0.8 mm, and even more preferably in the case where they satisfy the relationship w2+0.6 mm>w1>w2−0.6 mm, flexure originating at the connection portion of the upper rising portion 30 and the thick region 40 relatively increases.

4. Thickness Structure of Face Portion

Next, the thickness structure of the face portion 11 that contributes to an increase in the flight-distance will be described. The front surface side of the face portion 11 that serves as the ball hitting face is formed so as to be flat. On the other hand, unevenness is formed on the rear surface side of the face portion 11. In other words, the face portion 11 is constituted by multiple regions having different thicknesses.

Figure 6:
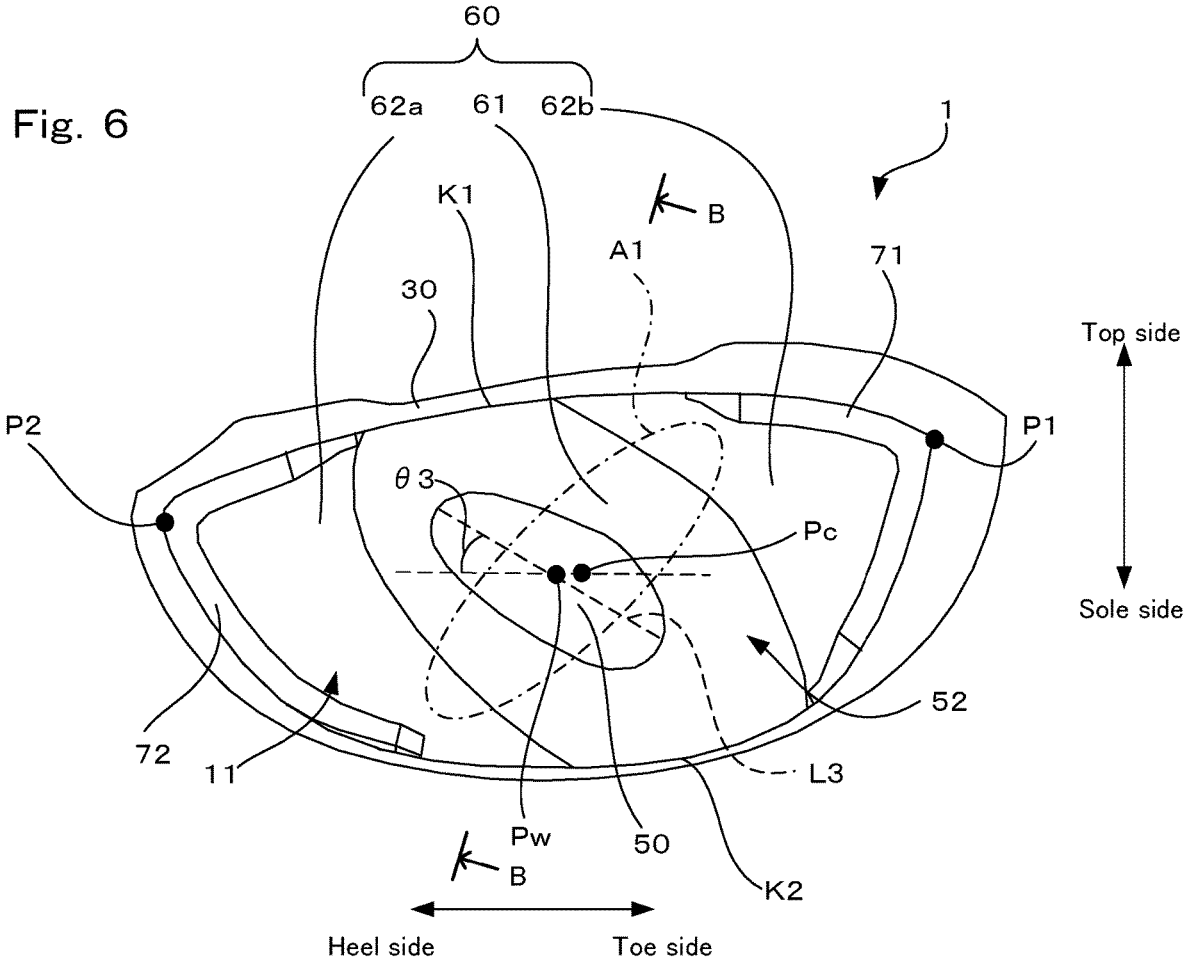
FIG. 6 is a rear view of a face member in the reference state.

FIG. 6 is a rear view of the face member 1 in the reference state. As shown in this figure, a thick central portion 50 is formed in the face portion 11, and a thin peripheral region 60 is formed so as to surround the central portion 50. The peripheral region 60 has a substantially ring-shaped transition portion 61 that surrounds the central portion 50 and comes into contact with the central portion 50, and thin portions 62*a* and 62*b* that further surround the transition portion 61 and come into contact with the transition portion 61. The transition portion 61 is thicker than the thin portions 62*a* and 62*b*, but is thinner than the central portion 50. Also, the thin portion 62*a* is the region on the heel side of the transition portion 61, and the thin portion 62*b* is the region on the toe side of the transition portion 61. In the present embodiment, the transition portion 61 is constituted so as to gradually decrease in thickness outward from the central portion 50, that is to say toward the thin portions 62*a* and 62*b*, and this change in thickness is continuous. However, the thicknesses of the transition portion 61 may be constant, and even in the case of changing, the thicknesses may change in a non-continuous manner, such as in a stepwise manner.

Figure 7:
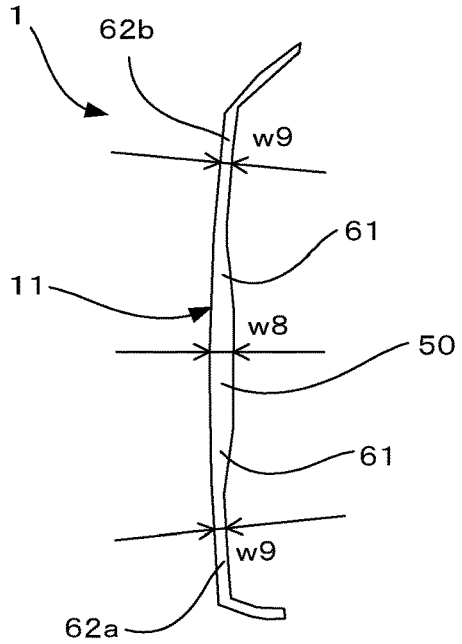
FIG. 7 is a cross-sectional view taken along line B-B in FIG. 6.

FIG. 7 is a cross-sectional view taken along line B-B in FIG. 6. In the present embodiment, a thickness w8 of the central portion 50 is substantially constant, and can be set to satisfy the relationship 2.0 mm≤w8≤4.5 mm, or more preferably satisfy the relationship 3.0 mm≤w8≤4.0 mm, for example. Also, in the present embodiment, a thickness w9 of the thin portions 62*a* and 62*b* is substantially constant and, for example, can be set to 1.5 mm≤w9≤3.0 mm or more preferably 1.8 mm≤w9≤2.6 mm. Accordingly, the central portion 50 is a low restitution area that has a relatively low restitution factor, and the thin portions 62*a* and 62*b* are high restitution areas that have a relatively high restitution factor.

Hereinafter, for the sake of convenience in the description, assuming that the head 100 is placed in the reference state, a point P1 farthest on the toe side on the peripheral edge of the face portion 11 will be referred to as the toe-side end point, and a point P2 farthest on the heel side on the peripheral edge of the face portion 11 will be referred to as the heel-side end point (see FIG. 6). Also, on the peripheral edge of the face portion 11, the top-side line extending from the toe-side end point P1 to the heel-side end point P2 will be referred to as a top line K1, and a sole-side line extending from the toe-side end point P1 to the heel-side end point P2 will be referred to as a sole line K2.

As shown in FIG. 6, the central portion 50 includes a face center Pc and a sweet spot located in the vicinity thereof, and is substantially elliptical overall. Note that the sweet spot is the intersection of the front surface of the face portion 11 and the perpendicular line from the center of gravity of the golf club head 100 to the face portion 11. Also, the central portion 50 extends in the shape of an "I" so as to be inclined from the top side to the sole side along the direction from the heel side to the toe side. Let L3 be a line segment that passes through a center Pw (geometrical center) of the central portion 50, overlaps the central portion 50, and has a maximum length. An angle θ3 formed by the line segment L3 and the toe-heel direction can be set to 5°≤θ3<90°, for example. More preferably, it can be set to 30°≤θ3≤50°. Note that in the present embodiment, the face center Pc is specified as follows. Specifically, first, in the face portion, a maximum width Wx in the toe-heel direction is determined, and a central position Px in the toe-heel direction at the maximum width Wx is determined. Then, at the position Px, a central point Py in the up-down direction of the face portion is determined, and this point Py is defined as a face center Pc. Note that FIG. 3 is a cross-sectional view that passes through the face center Pc.

Also, the transition portion 61 surrounds the entirety of the central portion 50, and a central region 52 made up of the central portion 50 and the transition portion 61 also has a substantially elliptical shape overall. Also, the central region 52 also extends in the shape of an "I" so as to be inclined from the top side to the sole side along the direction from the heel side to the toe side. The transition portion 61 reaches the top line K1 and the sole line K2. In other words, the central region 52 extends over the entire face portion 11 in the top-sole direction, but is concentrated relatively in the central portion of the face portion 11 in the toe-heel direction, and does not reach the heel-side end point P2. Note that in the present embodiment, the geometrical center of the central region 52 is substantially equivalent to the face center Pc.

If the thickness of the face portion 11 rapidly decreased in the vicinity of the boundary line between the face portion 11 and the rising portion 12, stress would become concentrated in this thin portion, and there would be a risk of having an effect on the durability of the face portion 11. However, in the present embodiment, the transition portion 61 is continuous with the top line K1 and the sole line K2 as described above. In other words, the central portion 50 does not suddenly end in the vicinity of the rising portion 12, nor does the thickness of the face portion 11 rapidly decrease. The strength of the face member 1 is therefore ensured.

Also, generally, on the face surface, hit points are distributed along a straight line that passes through the face center Pc and is inclined from the sole side to the top side along the direction from the heel side toward the toe side. This hit point distribution region is a region surrounded by a dashed-dotted line A1 in FIG. 6, for example. Accordingly, it can be said that the aforementioned central portion 50 or central region 52 spreads out so as to intersect the hit point distribution region. As a result, the thick central portion 50 or central region 52 can be caused to flex in the direction of the spread of the hit point distribution region, and it is possible to increase the restitution factor in the hit point distribution region.

Also, in the present embodiment, as shown in FIG. 6, the center Pw of the central portion 50 is located on the heel side relative to the face center Pc. In other words, the central portion 50 is arranged inside the face portion 11, at a location closer to the heel side than to the toe side in the central region 52. As a result, it is possible to prevent an excessive rise in the restitution factor in the face portion 11.

Also, generally, the closer to the center of gravity of the head 100, the higher the restitution factor is anticipated to be during ball hitting. Accordingly, in the configuration of the present embodiment, the sweet spot is located on the heel side relative to the face center Pc on the face surface. Accordingly, it is possible to raise the restitution factor of the heel-side portion on the face portion 11.

Also, as shown in FIG. 6, a V-shaped slit (groove) 71 that is approximately centered on the toe-side end point P1 and extends along the boundary line between the face portion 11 and the rising portion 12 is formed on the inner surface of the face portion 11. Similarly, a V-shaped slit (groove) 72 that is approximately centered on the heel-side end point P2 and extends along the boundary line between the face portion 11 and the rising portion 12, is formed on the heel side as well. In other words, regions thinner than the thin portions 62*a* and 62*b* are formed in the vicinity of the toe-side end point P1 and the heel-side end point P2. With the slits 71 and 72, it is possible to increase the restitution factor in the toe-side and heel-side portions in particular. Accordingly, it is possible to prevent the high restitution area from being concentrated in the central region on the face surface, and to expand the high restitution area. As a result, it is possible to increase the flight-distance even if the ball is not grabbed at the central region of the face portion 11 in a mishit or an intentional shot, for example.

5. Variations

Although an embodiment of the present invention has been described above, the present invention is not limited to this embodiment, and various modifications can be made without departing from the gist of the invention. The following are examples of modifications that can be made. The features of the following variations can be combined as appropriate.

5-1

In the above embodiment, the high restitution area on the face portion 11 is expanded by setting the rigidity of the first central portion 20*c* higher than the rigidity of the first toe-side portion 20*a* and the first heel-side portion 20*b*. However, the method for realizing this function is not limited to the method described above. For example, one rib 21 may be formed on the first central portion 20*c*, and the extending direction of the rib 21 can also be set as desired. Also, the ribs 21 are not limited to being straight lines, and may be curved. Instead of or in addition to the ribs 21, projecting portions that are circular, quadrilateral, or the like can also be formed. Moreover, instead of or in addition to forming the ribs 21 in the first central portion 20*c*, the first central portion 20*c* can be formed thicker than the first toe-side portion 20*a* and the first heel-side portion 20*b*. Furthermore, in order to realize this function, as long as the rigidity of the first central portion 20*c* is set higher than the rigidity of the first toe-side portion 20*a* and the first heel-side portion 20*b*, ribs (projecting portions) can be provided on not only the first central portion 20*c*, but also the first toe-side portion 20*a* and the first heel-side portion 20*b*. In this case, it is possible to, for example, provide the ribs (projecting portions) formed on the first central portion 20*c* so as to be more concentrated than those on the first toe-side portion 20*a* and the first heel-side portion 20*b*.

5-2

Figure 8:
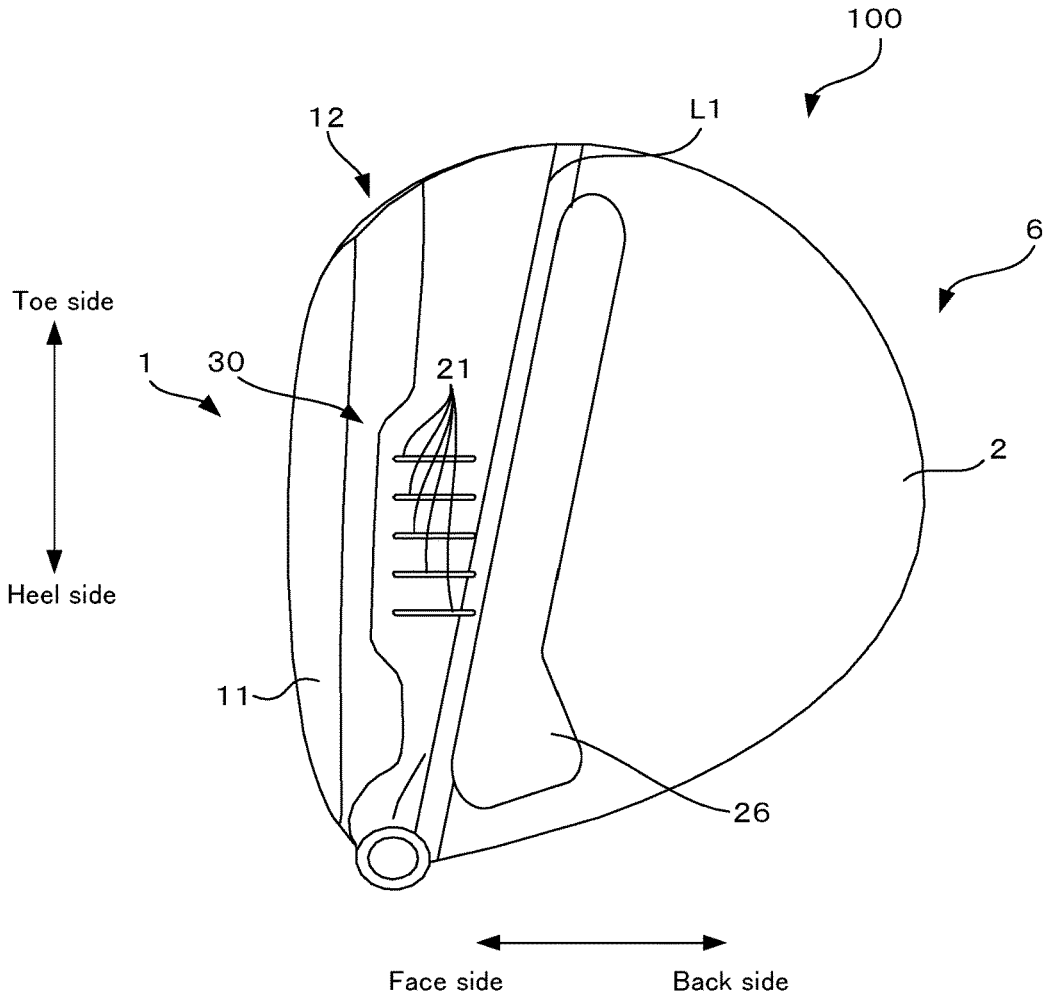
FIG. 8 is a plan view of the golf club head in the reference state, showing the structure of the inner surface of the crown portion according to a variation.

In the configuration of the above embodiment, the ribs 25 are used to increase the rigidity at the front edge of the thin portion 41*b* and cause bending to originate in the vicinity of the boundary line L1. However, the method for realizing this function is not limited to the method described above. For example, the extending direction of the ribs 25 can be set as desired, and the ribs 25 may be curved instead of being straight lines. Also, instead of or in addition to the ribs 25, it is possible to form protruding portions that are circular, elliptical, quadrilateral, or the like. For example, as shown in FIG. 8, it is possible for the thick region 26 to be a band-shaped region in which the ribs 25 are formed in the above embodiment.

5-3

In the above embodiment, sections 2, 3, and 4 describe the structure in the vicinity of the connection portion of the face member 1 and the head body 6, as well as the thickness structures of the crown portion 2 and the face portion 11. These structures each contribute to an increase in the flight-distance, and these features can each be independently applied in a golf club head. For example, the above-described thickness structure of the crown portion 2 is also applicable to a golf club head that includes a face member that does not have the rising portion 12 and is not cup face-shaped.

5-4

Figure 9:
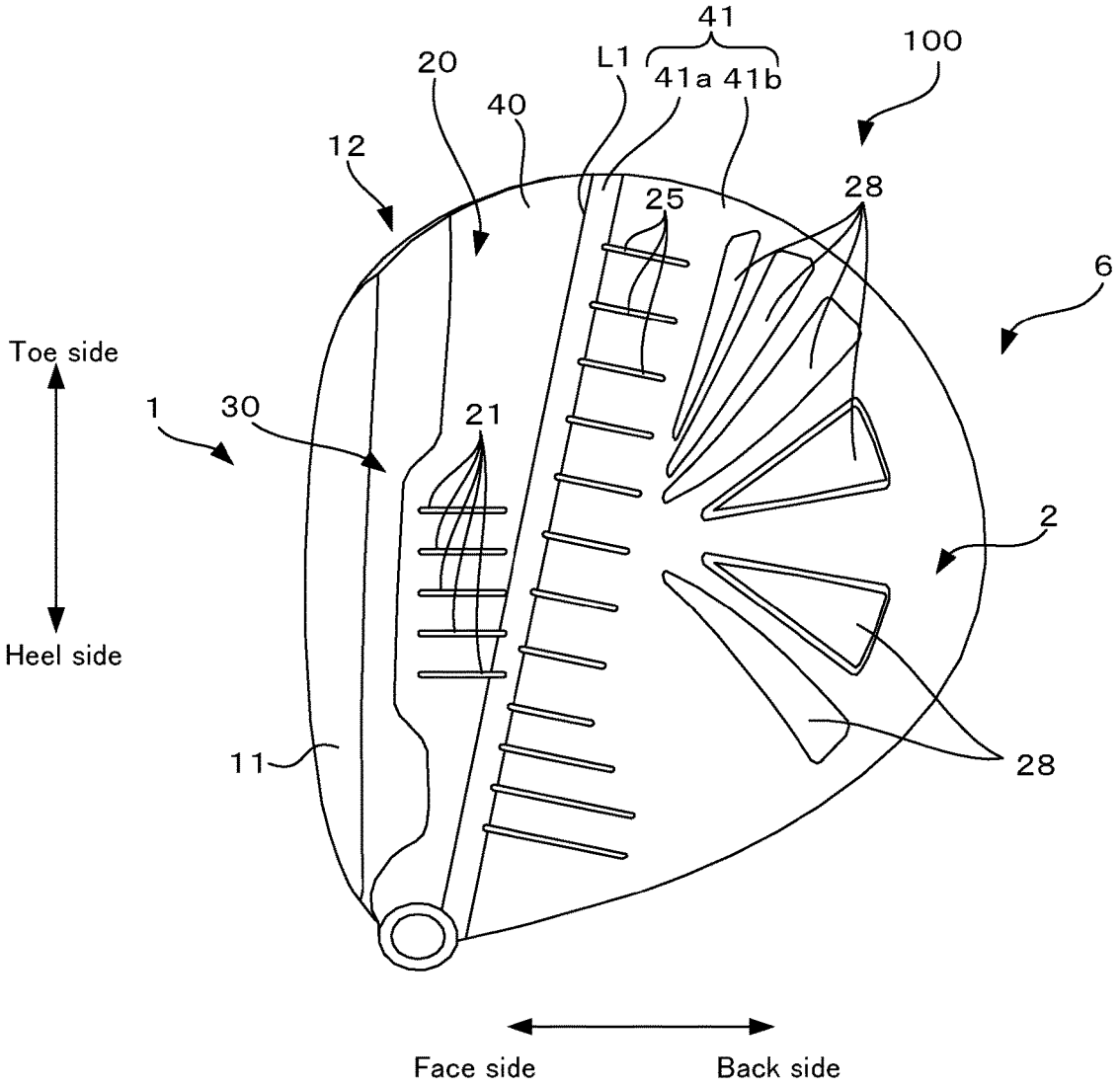
FIG. 9 is a plan view of a golf club head in the reference state, showing the structure of the inner surface of the crown portion according to another variation.

As shown in FIG. 9, raised portions 28 may be formed on the rear end portion of the thin portion 41*b*. These raised portions 28 can take various aspects. They can have an approximately triangular shape as shown in FIG. 9, and/or one or more can be formed. Furthermore, as shown in FIG. 9, the raised portions 28 can be arranged in a radiating manner at positions avoiding the heel-side portion, in an aspect in which their vertices are gathered together at approximately the same point. Accordingly, it is possible to reduce the weight of the head 100, and thus it is possible to increase the moment of inertia.

REFERENCE SIGNS LIST

1 Face member
2 Crown portion
6 Head body
11 Face portion
12 Rising portion
30 Upper rising portion
20 Front edge portion of crown portion
40 Thick region (first region)
41 Thin region (second region)
41*a* Thickness transition portion
41*b* Thin portion
25 Rib (protruding portion)
50 Central portion
60 Peripheral region
61 Transition portion
62*a*, 62*b* Thin portion
L1 Boundary line
Pc Face center
P1 Toe-side end point
P2 Heel-side end point

The invention claimed is:

1. A golf club head comprising a face portion, a crown portion, a sole portion, and a side portion, wherein the golf club head has a single hollow portion extending to the face portion, the crown portion, the sole portion and the side portion, the hollow portion is void of any material other than air, the crown portion includes:

a first region that spreads out forward of a boundary line that extends from a heel side to a toe side, a second region that spreads out rearward of the boundary line and is thinner than the first region, and a protruding portion formed at position that is in a vicinity of the boundary line, is on an inner surface of the second region, and is rearward of the boundary line via a gap, the protruding portion protruding into the hollow portion, wherein the first region and the second region are in contact with each other across a full length of the boundary line continuously extending in a toe-heel direction, wherein the boundary line extends from the heel side to the toe side in a vicinity of an apex line along the apex line, the apex line constitutes a ridge line of an apex portion of the crown portion when the golf club head in a reference state is viewed from the face portion side, and wherein the protruding portion is formed at position that is in a vicinity of the apex line and is rearward of the apex line via a gap.

2. The golf club head according to claim 1, wherein the boundary line extends from a front side to a rear side as it extends from the heel side to the toe side.

3. The golf club head according to claim 1, wherein the protruding portion is constituted by a plurality of ribs aligned along the boundary line.

4. The golf club head according to claim 2, wherein the protruding portion is constituted by a plurality of ribs aligned along the boundary line.

5. The golf club head according to claim 3, wherein the ribs extend in the face-back direction.

6. The golf club head according to claim 4, wherein the ribs extend in the face-back direction.

7. The golf club head according to claim 1, wherein the second region includes a thickness transition portion that is thinner than the first region, and a thin portion that is thinner than the thickness transition portion and spreads out rearward of the thickness transition portion, the thickness transition portion extending from the heel side to the toe side with it being in contact with the boundary line.

8. The golf club head according to claim 1, further comprising:

a rising portion that extends rearward from a peripheral edge of the face portion, wherein the crown portion, the sole portion, and the side portion constitute a head body with a hollow structure that has an opening on a front side, and the rising portion, together with the face portion, constitutes a cup face member that is connected to the head body so as to block the opening on the front side of the head body.

9. The golf club head according to claim 8, wherein the rising portion includes an upper rising portion that is connected to a front edge of the first region, and letting w1 be the thickness of the upper rising portion, and w2 be the thickness of a front edge portion of the crown portion, a relationship w2+1 mm>w1>w2−1 mm is satisfied.

10. The golf club head according to claim 1, wherein a sweet spot is located on a heel side relative to a face center on the face portion.

11. The golf club head according to claim 1, wherein the face portion includes a central portion that extends so as to be inclined from a top side to a sole side along a direction from the heel side to the toe side, and a peripheral region that is thinner than the central portion and surrounds the central portion.

12. The golf club head according to claim 11, wherein the peripheral region has a transition portion that surrounds the central portion, and a thin portion that surrounds the transition portion and is thinner than the transition portion, and the central portion is arranged so as to be closer to the heel side than to the toe side in a region made up of the central portion and the transition portion.

13. The golf club head according to claim 11, wherein the face portion has a toe-side end point that is a point farthest on the toe side and a heel-side end point that is a point farthest on the heel side, and the face portion further includes a region that is thinner than the peripheral region and extends along a peripheral edge of the face portion at least one of in a vicinity of the toe-side end point and in a vicinity of the heel-side end point.

14. The golf club head according to claim 1, wherein the second region has a thickness t2 of 0.3 mm<t2<3.5 mm.

15. The golf club head according to claim 1, wherein the first region has a thickness t1 of 0.4 mm<t1<3.5 mm.

16. The golf club head according to claim 14, wherein the first region has a thickness t1 of 0.4 mm<t1<3.5 mm.

* * * * *